US005556369A

United States Patent [19]

Roberts

[11] Patent Number: 5,556,369

[45] Date of Patent: Sep. 17, 1996

[54] EXERCISE DEVICE

[76] Inventor: William J. Roberts, 22 Fisher Ave., Wellesley, Mass. 02181

[21] Appl. No.: 201

[22] Filed: Jan. 4, 1993

Related U.S. Application Data

[63] Continuation-in-part of Ser. No. 516,790, Apr. 30, 1990, Pat. No. 5,176,602, which is a continuation-in-part of Ser. No. 274,705, Nov. 15, 1988, Pat. No. 4,921,245, which is a continuation of Ser. No. 929,409, Nov. 10, 1986, abandoned.

[51] Int. Cl.[6] ..... A63B 21/00

[52] U.S. Cl. ..... 482/131; 482/24; 482/904

[58] Field of Search ..... 482/121, 122, 482/126, 129, 131, 904, 906, 907, 24

[56] References Cited

U.S. PATENT DOCUMENTS

| | | | |
|---|---|---|---|
| 618,990 | 2/1899 | Lobben . | |
| 715,530 | 12/1902 | Wallace . | |
| 1,495,536 | 5/1924 | Smith . | |
| 1,503,550 | 8/1924 | Nelson et al. . | |
| 2,932,510 | 4/1960 | Kravitz . | |
| 2,944,815 | 7/1960 | Moyer . | |
| 3,117,760 | 1/1964 | Dresbach et al. . | |
| 3,226,115 | 12/1965 | Underhill . | |
| 3,473,801 | 10/1969 | Nissen et al. . | |
| 3,709,487 | 1/1973 | Walker . | |
| 3,765,674 | 10/1973 | Siler . | |
| 3,825,299 | 7/1974 | Gaucher . | |
| 3,874,657 | 4/1975 | Niebojewski . | |
| 4,047,714 | 9/1977 | Powell | 482/131 |
| 4,060,240 | 11/1977 | Dunston | 482/131 |
| 4,129,916 | 12/1978 | Schlesinger et al. . | |
| 4,241,914 | 12/1980 | Bushnell . | |
| 4,257,592 | 3/1981 | Jones . | |
| 4,326,708 | 4/1982 | Hinds . | |
| 4,463,948 | 8/1984 | Mohr | 482/129 |
| 4,487,413 | 12/1984 | Fall . | |
| 4,544,155 | 10/1985 | Wallenbrock et al. | 482/129 |
| 4,620,701 | 11/1986 | Mojden . | |
| 4,948,117 | 3/1990 | Burke | 482/129 X |

FOREIGN PATENT DOCUMENTS

| | | | |
|---|---|---|---|
| 1400480 | 4/1965 | France | 482/131 |
| 441903 | 11/1948 | Italy | 482/129 |

OTHER PUBLICATIONS

Ad For "Stretcher–Cizer" *Black Belt* Jan. 1974.
DP Company Catalog, p. 29.
Duro–Med Inc. Brochure.
Joe Weider Product Brochure.
Lifeline, USA Brochure, pp. 1–50.

*Primary Examiner*—Richard J. Apley
*Assistant Examiner*—John Mulcahy

[57] ABSTRACT

Exercised systems are disclosed which are adapted for connection to at least one structural component of a building to provide a framework for kinesthetic exercises. Structures are disclosed which define a plurality of fixable locations for the connection of various kinesthetic exercising apparatus in arrangements suitable for a variety of kinesthetic exercises. The systems further include mechanisms for quick releasable and replaceable coupling of exercise apparatus in a freely rotatable manner to accommodate a wide range of body motions.

4 Claims, 15 Drawing Sheets

EXERCISE DEVICE

REFERENCE TO RELATED APPLICATION

This is a Continuation-In-Part of U.S. Ser. No. 07/516,790 filed Apr. 30,1990, now U.S. Pat. No. 5,176,602, which is a Continuation-In-Part of U.S. Ser. No. 274,705 filed Nov. 15, 1988, now U.S. Pat. No. 4,921,245, which is a Continuation of U.S. Ser. No. 929,409 filed Nov. 10, 1986, now abandoned.

BACKGROUND OF THE INVENTION

The technical field of this invention is exercise systems and, in particular, systems which permit the user to engage in kinesthetic exercises and whole body movements.

Kinesthesia is a class of exercise that is designed to improve agility, balance and coordination. Conventional exercise machines typically exercise isolated muscles (e.g., biceps or triceps). Kinesthetics, on the other hand, involves not just isolated muscles but also the "mid-course corrector" muscles that provide feedback control and the "core stabilizer" muscles in the torso and pelvis that maintain balance. Kinesthetic and brachiating exercises, such as extension, stretching, twisting, hanging and swinging exercises and their inverted variations, have long been recognized to help in the alignment of the skeleton and development of the musculature to attain and maintain ideal posture, coordination, equilibrium and strength.

Unfortunately, however, there are few opportunities for most individuals to engage in such kinesthetic exercises outside of a gymnasium in which large, free-standing apparatus are set up for use. There exist a need for exercise devices and systems which would permit the user to engage in kinesthetic exercises outside of the gymnasium environment. In particular, exercise devices which can be used within a home or other building would satisfy a long-felt need in the art.

In parent application U.S. Ser. No. 274,705, the present applicant disclosed a variety of exercise devices adapted for use within a home. The present invention elaborates on the principles disclosed in the earlier case and provides additional embodiments of exercise devices which permit the user to engage in a variety of kinesthetic exercises quickly and simply at home, in the office or while traveling.

SUMMARY OF THE INVENTION

Exercised systems are disclose which are adapted for connection to at least one structural component of a building to provide a framework for kinesthetic exercises. Structures are disclosed which define a plurality of fixable locations for the connection of various kinesthetic exercising apparatus in arrangements suitable for a variety of kinesthetic exercises. The systems further include mechanisms for quick releasable and replaceable coupling of exercise apparatus in a freely rotatable manner to accommodate a wide range of body motions.

In one aspect of the invention, an exercise device is disclosed which is adapted for connection to a door frame using at least one frame anchorage element. In one embodiment, the frame anchorage element can include a stop portion which is adapted for positioning on one side of the door and a receptacle on the other side of the door for attachment of kinesthetic exercise apparatus. In another embodiment, the anchorage element can be a rigid, hinged element adapted to be secured about a door.

In another aspect of the invention, exercise devices are disclosed which include mounting elements which are adapted to be secured to a structural component of a building (e.g., a wall or ceiling of a room) with each mounting element defining a plurality of fixable locations for the connection of various kinesthetic exercising apparatus.

In yet another embodiment, the exercise system can include a structural frame which is adapted to fit within a confined space, such as an alcove, hallway or room corner. This structural frame, likewise, provides a plurality of fixable locations for the connection of various kinesthetic exercising apparatus.

The exercise systems of the present invention permit the user to engage in a wide variety of fitness exercises. In particular, the systems are adapted to permit the user to engage in kinesthetic exercises which improve agility, balance and coordination. Such exercises typically involve whole body movements which exercise major muscle groups and multiple joint movements all at once. Kinesthetic exercises are accommodated by the present invention via structure that are compact and stable, but yet permit almost unlimited freedom of motion via the releasable attachment of various kinesthetic exercise apparatus.

Many exercises can be done on the devices of the present invention, including, for example, brachiating, stretching and swinging exercises. Due to the multiple attachment points, the exercise devices can accommodate multiple apparatus and multiple positions, as well as accommodate users of varying sizes.

The exercise apparatus useful in the present system includes handles, stirrups, cuffs, straps, pulleys, elastic elements and the like. The systems permit almost complete freedom of movement and extension, facilitating stretching, alignment and exercises that combine stretching and strengthening of muscles.

The invention will next be described in connection with certain illustrated embodiments. However, it should be clear that various additions, subtractions and modifications can be made by those skilled in the are without departing from the spirit or the scope of the present invention. For example, although an exercise system is disclosed in which a structural framework is fit into a corner of a room, it should be clear that similar structural frameworks of square or rectangular shape can also be fabricated according to the present invention and fit, for example, in a hallway near the ceiling in order to provide an exercise space within a hallway.

DETAILED DESCRIPTION

Figure 1:
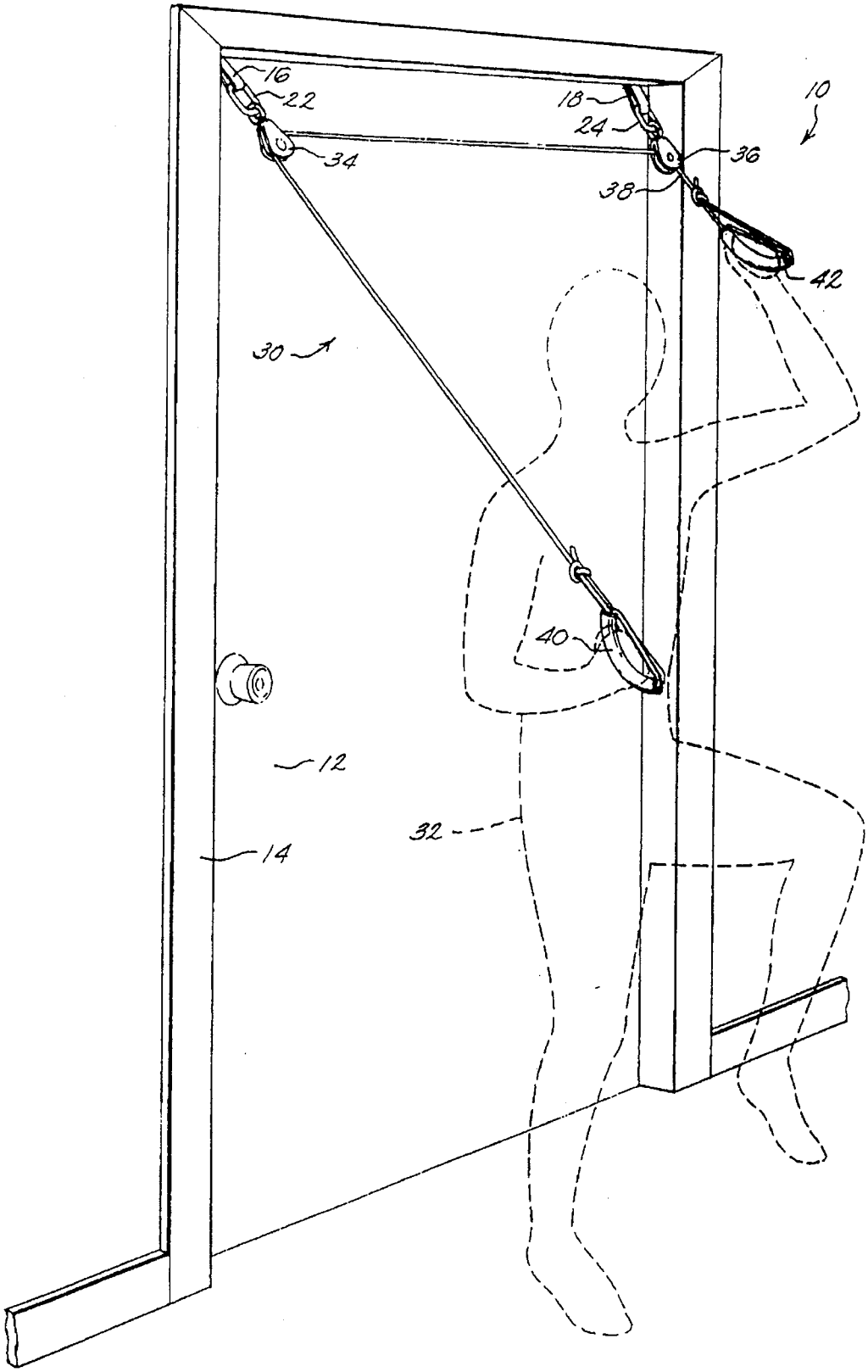
FIG. 1 is an illustration of an exercise device attached to a door according to the present invention.

In FIG. 1, an exercise system 10 is shown adapted for connection to a structural component of a building, e.g., a door 12 and its frame 14. As shown, the system can include first and second door frame anchorage elements 16 and 18, which cooperate with first and second coupling elements 22 and 24, respectively, to secure a kinesthetic exercise apparatus 30. Exercise apparatus 30 includes an arrangement of two pulleys 34 and 36, a rope 38 and handles 40 and 42. In use, handles 40 and 42 are gripped by a user 32 (shown in phantom) to permit range-of-motion exercises to be performed by pulling on one handle and then the other.

The placement of the anchorage elements 16 and 18 can be varied along the door frame to accommodate different exercises and variations in the size of the user. Handle 40 and 42 can, likewise, be adjustable to shorten or lengthen the rope 38. In one embodiment, the handle, itself, can be a tubular, plastic element, through which the rope is passed. By doubling the rope passage through the tube and then securing the rope in a clinch, the length of the rope 38 can be adjusted and then secured in place.

Figure 2:
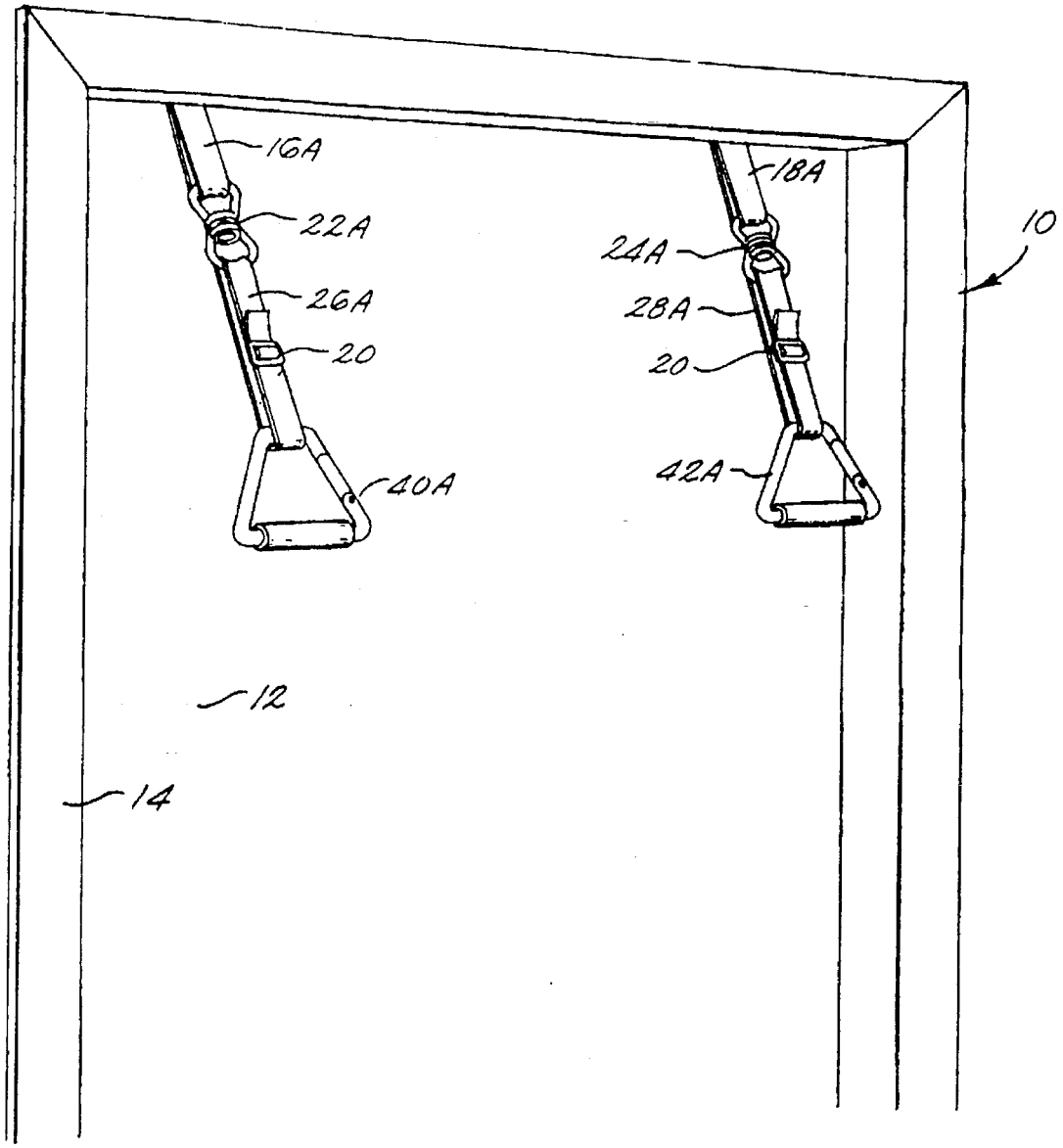
FIG. 2 is an illustration of another exercise device according to the invention having an alternative kinesthetic exercise apparatus attached thereto.

In FIG. 2, an alternative arrangement of the exercise system 10 is shown incorporating door frame anchorage elements 16A and 18A, which are connected to double-gated, swivel ring elements 22A and 24A, which are, in turn, connected to adjustable straps 26A and 28A, respectively. The length of these straps can be varied to accommodate different users. The straps 26A and 28A are further connected to gated handles 40A and 42A for gripping by a user. In use, the exercise apparatus of FIG. 2 permits a user to engage in kinesthetic exercises by stretching and pulling against the handles while also allowing a wide range of body movement.

Figure 3:
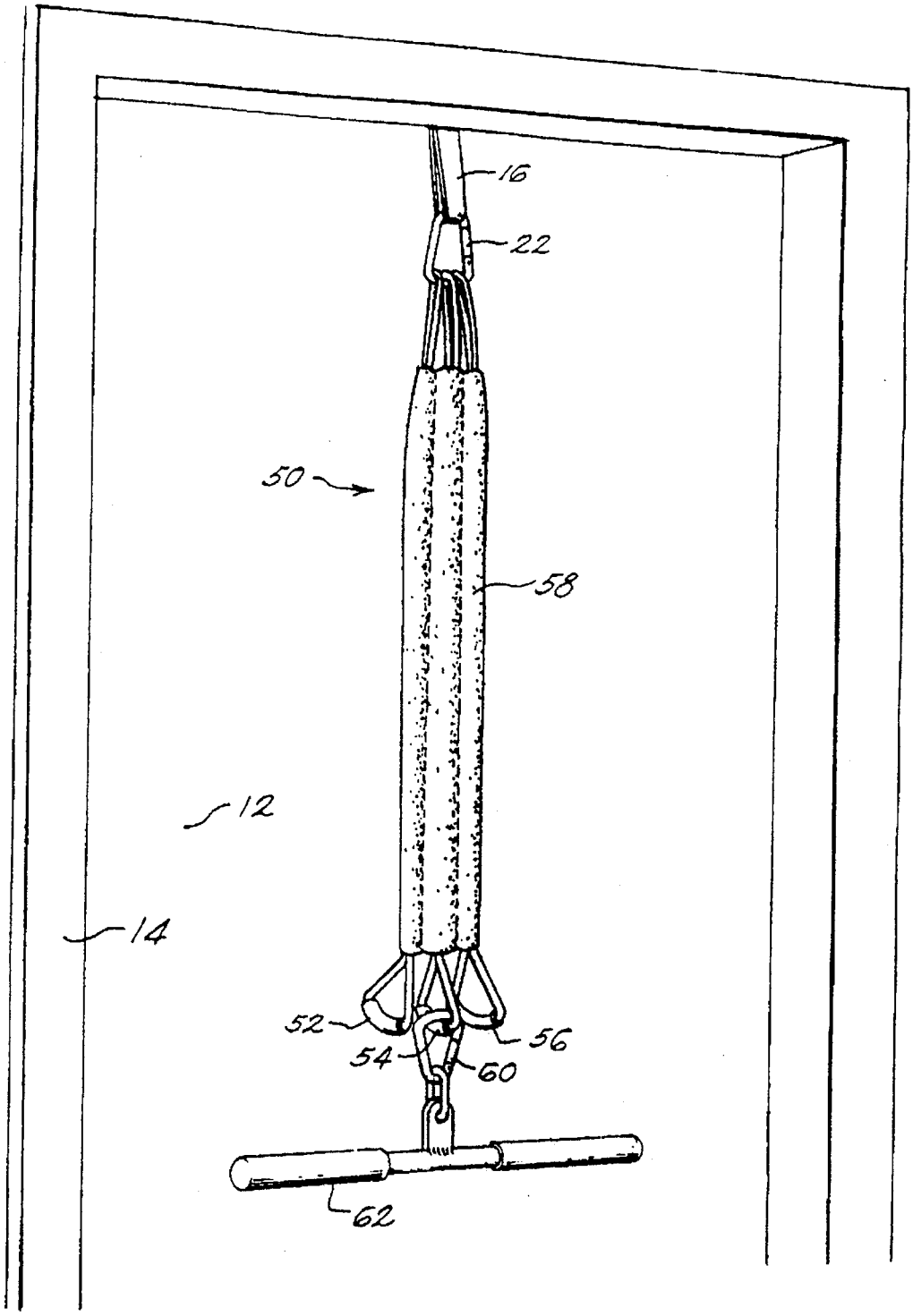
FIG. 3 is an illustration of yet another exercise device according to the invention.

In FIG. 3, yet another embodiment of the exercise system 10 is shown including one door frame anchorage element 16, a coupling element 22, and a variable-resistance, elastic exercise apparatus 50. Again, the system 10 is secured in place between a door 12 and its frame 14 by the anchorage element 16. The exercise apparatus 50 includes three elastic elements, 52, 54 and 56, which are all connected to the coupling ring 22 at one end. At their other ends, the elastic element can be selectively attached to a second coupling element 60, which is, in turn, connected to a handle 62. To increase the resistance of the apparatus 50, two or more of the elastic elements are connected to the coupling ring 60. The apparatus can further include a protective jacket or sleeve 58 which surrounds the elastic elements 52, 54 and 56 to prevent entanglement.

Figure 4:
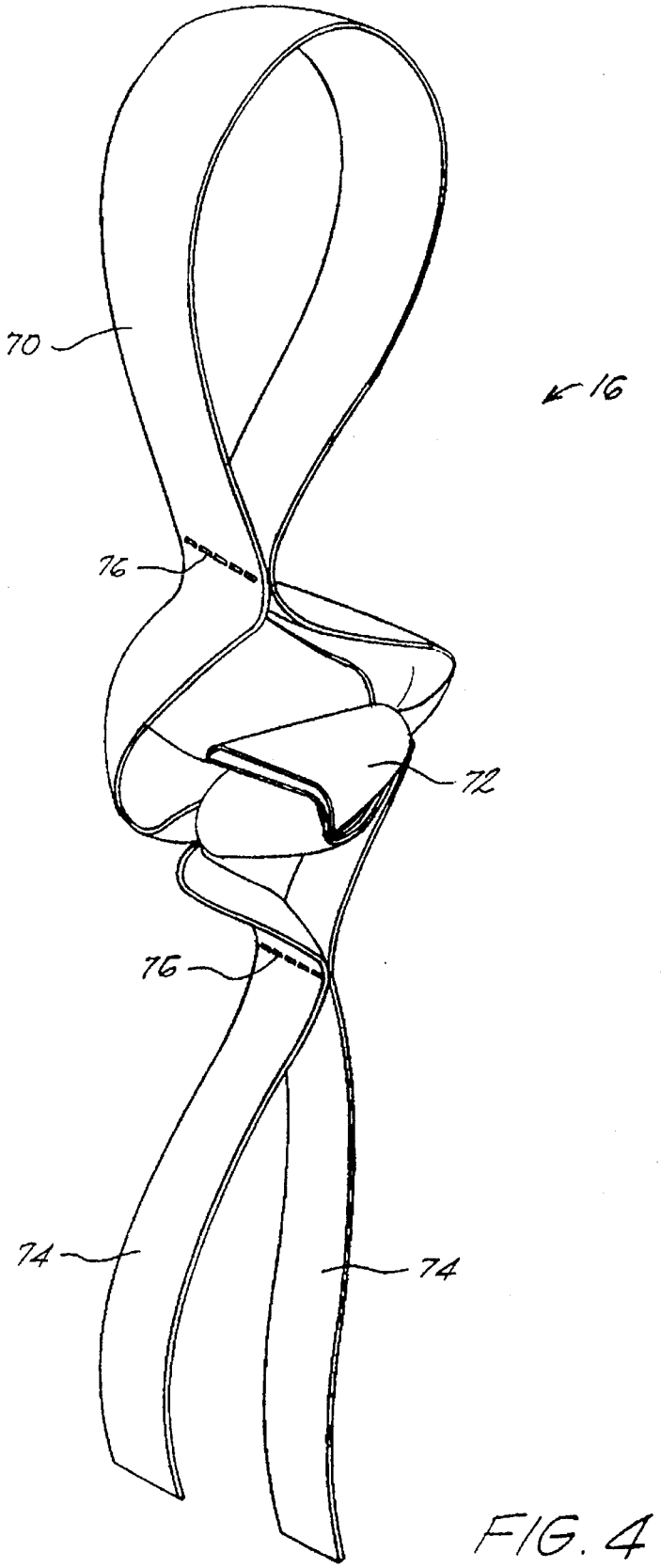
FIG. 4 is an illustration of a door anchorage element for use in exercise devices according to the invention.

A simple door anchorage element 16 is shown in FIG. 4 consisting of a nylon belt 70 with a knotted stop 72 and tail portions 74. Although the anchorage element 16 is illustrated with a woven nylon belt material, it should be clear that various other materials and shapes can be employed. Moreover, the knotted stop can be replaced by a variety of other elements which serve to obstruct slippage of the anchorage elements between the door and its frame. For example, the knotted stop 72 can be replaced by a simple, rigid plate which would be disposed on one side of the door allowing the belt to project through the frame and to the other side of the door in order to provide an attachment means for kinesthetic exercise apparatus. When a knotted stop 72 is employed, as shown, it is preferable that the belt portions directly above and below the knot 72 be secured by stitches 76 to preclude the knot from becoming untied. Most preferably, but not illustrated, the stitches 76 should be directly adjacent the ends of the knotted stop 72 so that the loop receptacle is unrestricted and can be placed around the corner of a door. The tail portions 74 can be folded back over the knot in order to adjust the thickness of the belt as it passes between the door frame and the door. Such adjustments can be made to accommodate different doors having varying degrees of clearance.

Figure 5A:
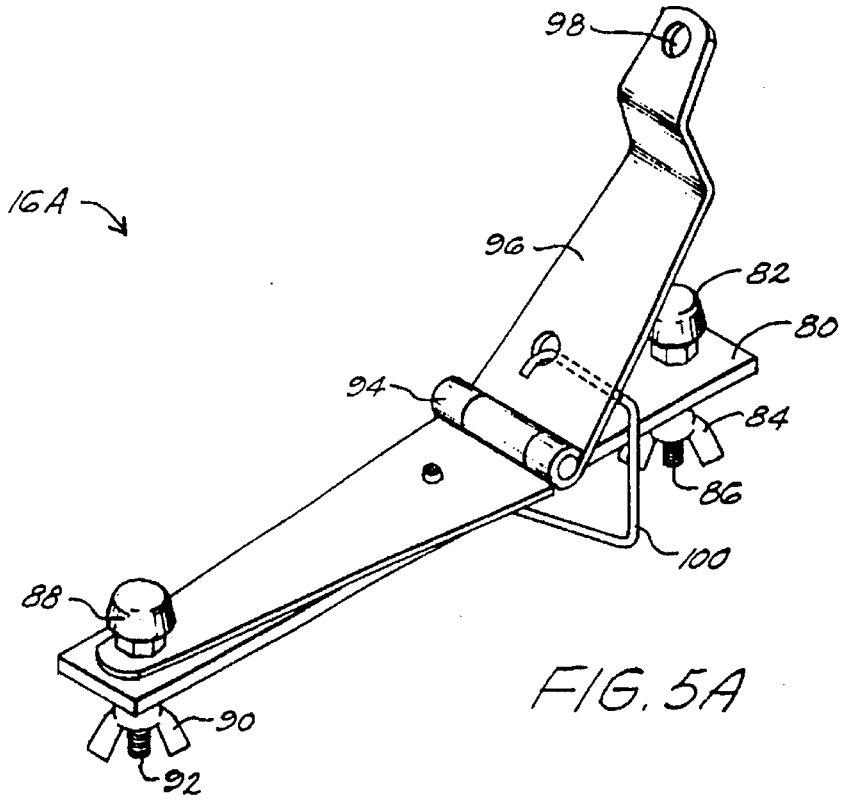
FIG. 5A and 5B are illustrations of an alternative door anchorage element for use in exercise devices according to the invention.
Figure 5B:
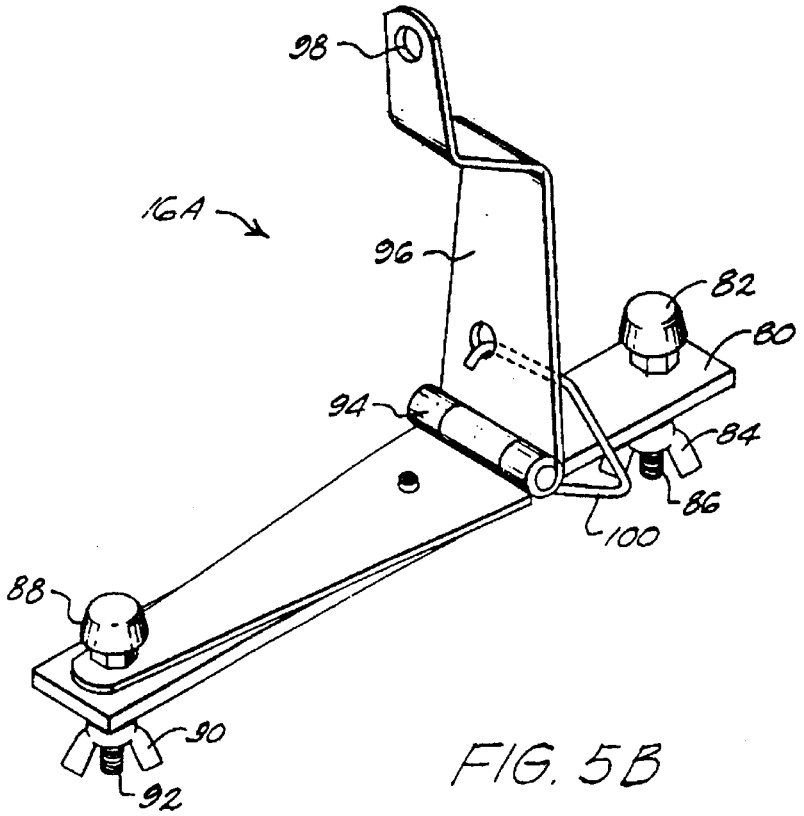

Another door anchorage element 16A is shown in FIGS. 5A and 5B. In FIG. 5A, the anchorage element 16A is shown in its open position which allows the user to slide it between the door and its frame (particularly, on the hinged side of the door). As shown in FIGS. 5A and 5B, the anchorage element 16A includes a base plate 80 with two pads (e.g., of a resilient rubber or similar material) 82 and 88, which are connected to threaded posts 86 and 92, respectively, which pass through the base plate 80.

The placement of the pads 82 and 88 against the door and door frame, in use, can be adjusted by the adjustment means 84 and 90, which can be, for example, one or more threaded nuts and spacers, to alter the height of the pads 82 and 88 with respect to the base plate 80.

Anchorage element 16A shown in FIGS. 5A and 5B further includes a hinged arm element 96 connected to the base plate 80. The arm 96 pivots on hinge 94 and further includes a hole 98 which serves as the attachment means for kinesthetic exercise apparatus. As shown in FIG. 5B, spring 100 urges the arm element 96 into an upright position during use, such that the arm 96 and the base plate 80 form a bracket which surrounds the edge of a door.

Figure 6:
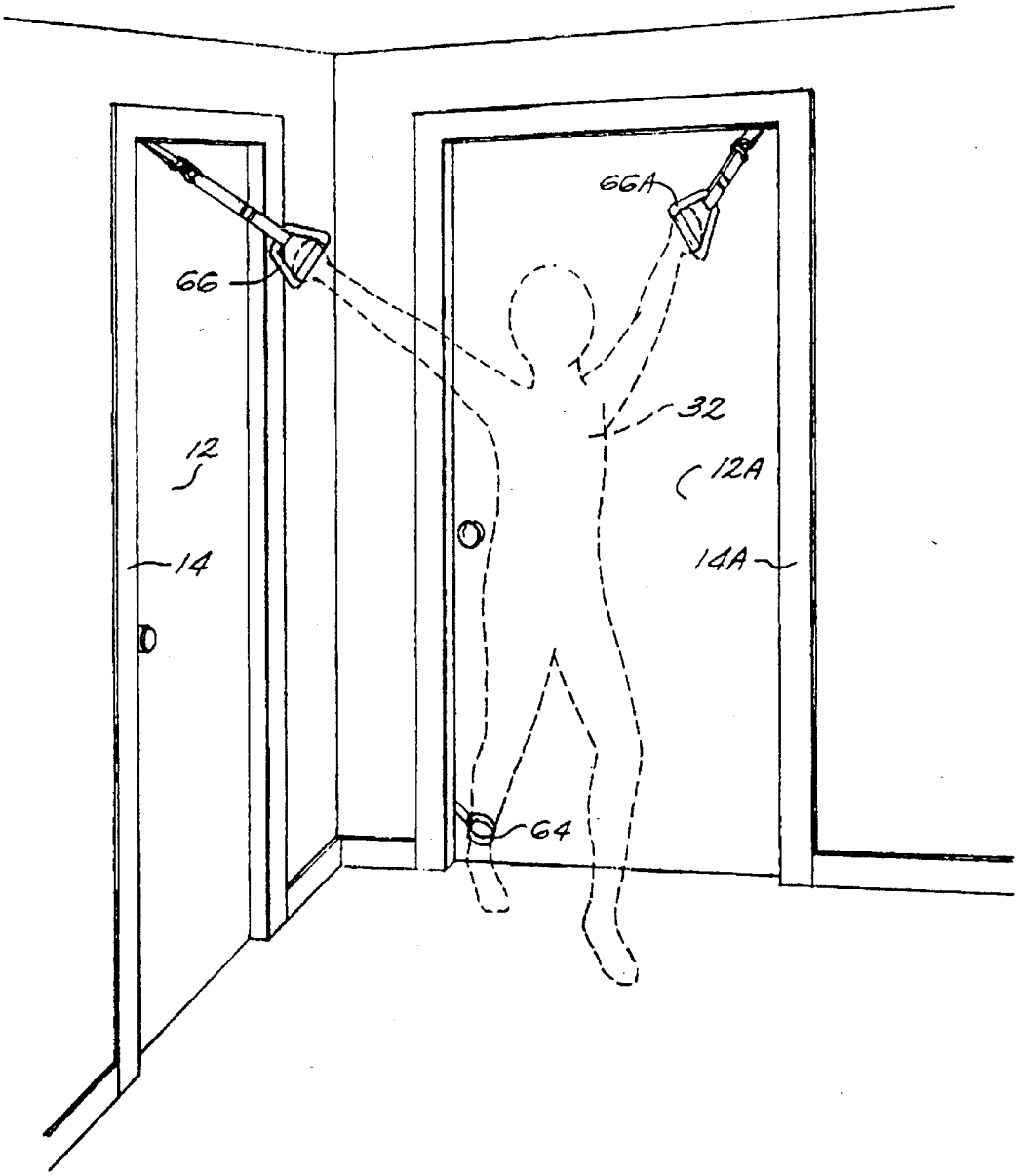
FIG. 6 is an illustration of another exercise device employing two-door frames.

In FIG. 6, an alternative exercise system 10A is shown in which a user 32 has connected door frame anchorage elements to a first door 12 and its frame 14, as well as a second door 12A and its frame 14A. By using two door frames, a further range of kinesthetic exercises, such as extension, stretching, twisting, hanging, and swinging exercises, can be practiced. As shown, the door frames support first and second hand gripes 66 and 66A, as well as a foot stirrup 64, to permit a stretching exercise.

Figure 7:
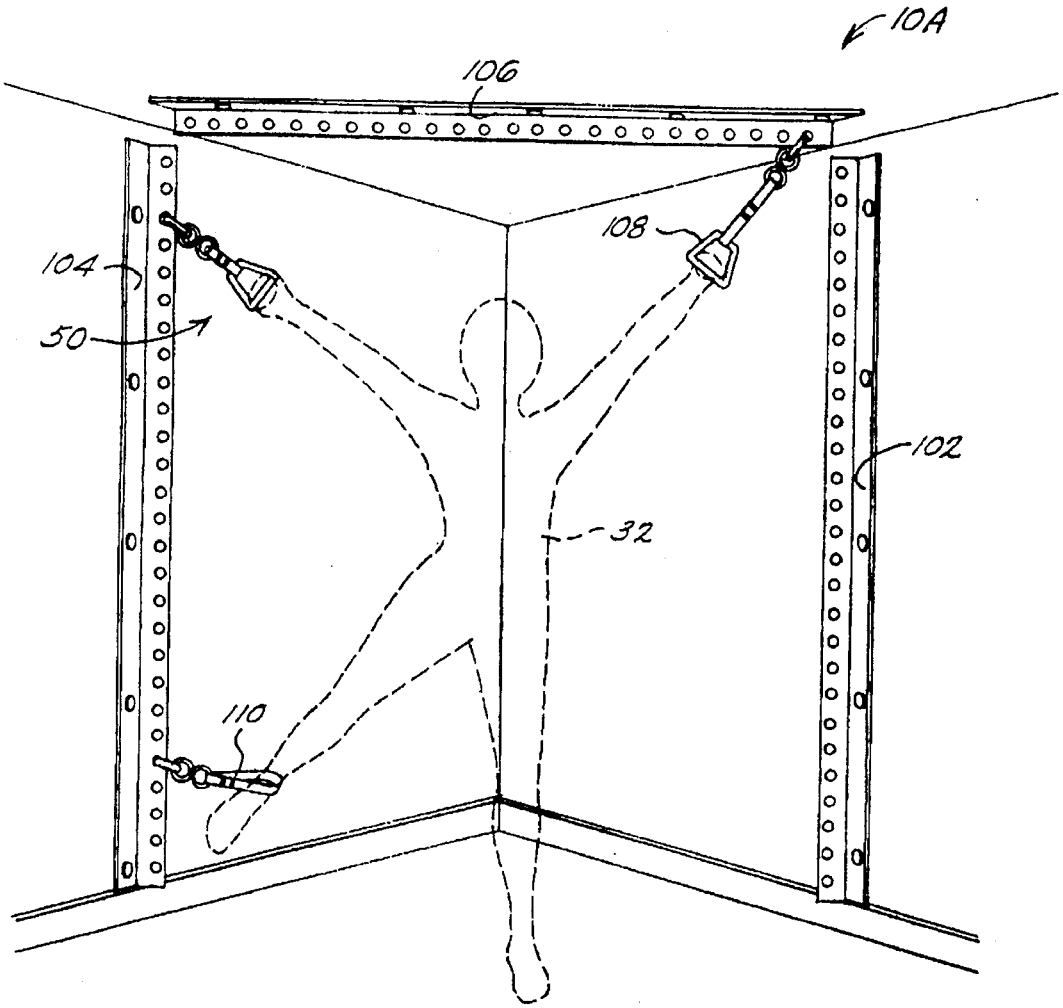
FIG. 7 is an illustration of another exercise device according to the invention adapted for mounting onto the walls and ceiling of a room.

In FIG. 7, another embodiment of the invention is shown in which mounting elements are physically attached to structural components of a building to provide receptacles for kinesthetic exercising apparatus. As shown, first wall-mounted element 103 and second wall-mounted element 104, as well as ceiling mounting element 106, are securely attached within a room. Each of the mounting elements 102, 104 and 106 include a plurality of receptacles for connection of kinesthetic exercising apparatus. As shown, this apparatus.15 includes handles 108 and foot straps 110, such that a user can perform stretching and swinging exercises.

Figure 8:
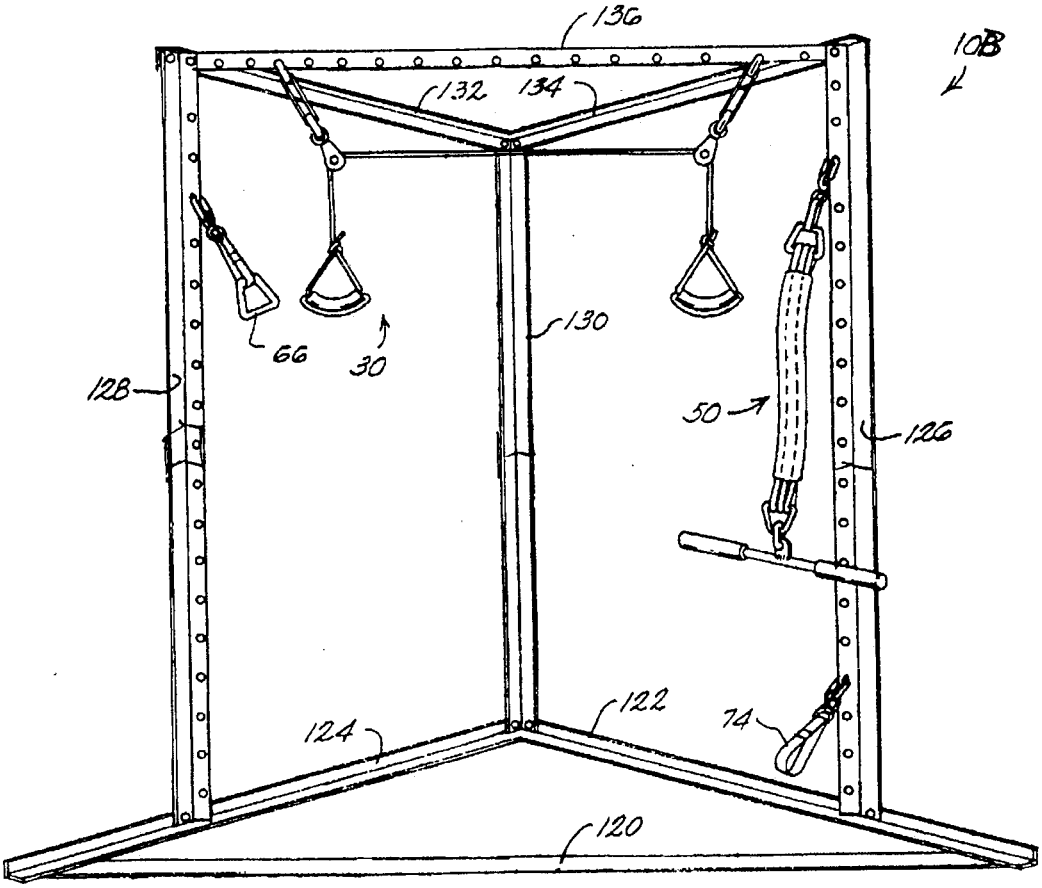
FIG. 8 is an illustration of yet another exercise device according to the invention adapted for placement in a corner of a room.

In FIG. 8, yet another embodiment of the exercise system 10B is shown in which a structural frame is adapted to fit within a confined space, e.g., a corne of a room. The frame includes a plurality of wall struts 126, 128 and 130, as well as a ceiling assembly formed by struts 132, 134 and 136 and a base assembly formed by struts 120, 122 and 124. When assembled and fitted into a corner, the frame is immobilized and provides a rigid structure for the connection of kinesthetic exercising apparatus. As shown, the system can support a pulley exercise device 30 (similar to that disclosed in FIG. 1), and an elastic exercise device 50 (similar to that disclosed in FIG. 3), as well as hand grip 66 and foot stirrup 74.

Figure 9:
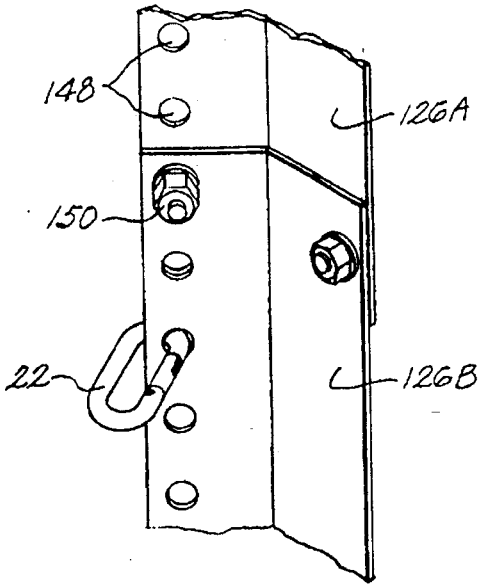
FIG. 9 is a more detailed illustration of an adjustment mechanism for use in the system FIG. 8.

The vertical struts of the system 10B can be adjusted to accommodate rooms of varying height. As shown in FIG. 9, one simple adjustment mechanism can employ a two-piece vertical strut assembly 126A and 126B, which are secured together by fasteners 150 (e.g., nuts and bolts, clips or the like). Each of the strut elements further includes a plurality of receptacles 148 into which coupling elements 22 can be fitted to support the kinesthetic exercise apparatus.

Figure 10:
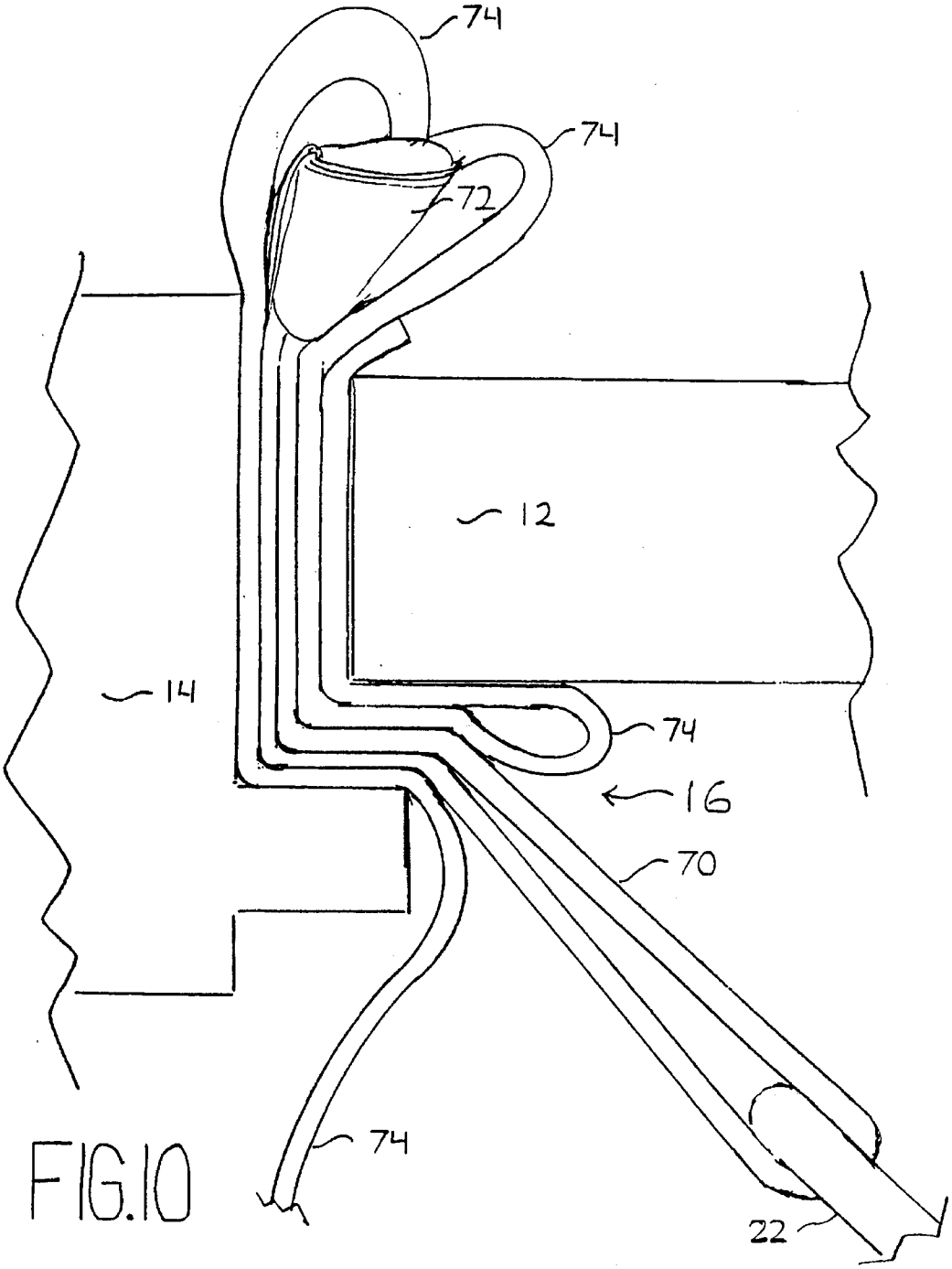
FIG. 10 illustrates anchorage element #16 with tail portions #74 folded for adjustment of the clearance between door #12 and the frame #14.

In FIG. 10 anchorage element #16 is shown frictionally clamped in between door #12 and doorframe #14. Tail portions #74 are folded back over the stopknot to adjust the thickness of the belt and fill the clearance so that frictional clamping is possible and the element cannot unintentionally slide along the edge of the door causing the user to lose balance or be injured. Tension or force applied by the user upon an exercise element connected to coupling element #22 connected to belt #70 is directed against stopknot #72 and not the tail portions #74 and therefore cannot disengage or disrupt the frictional clamping.

Figure 11:
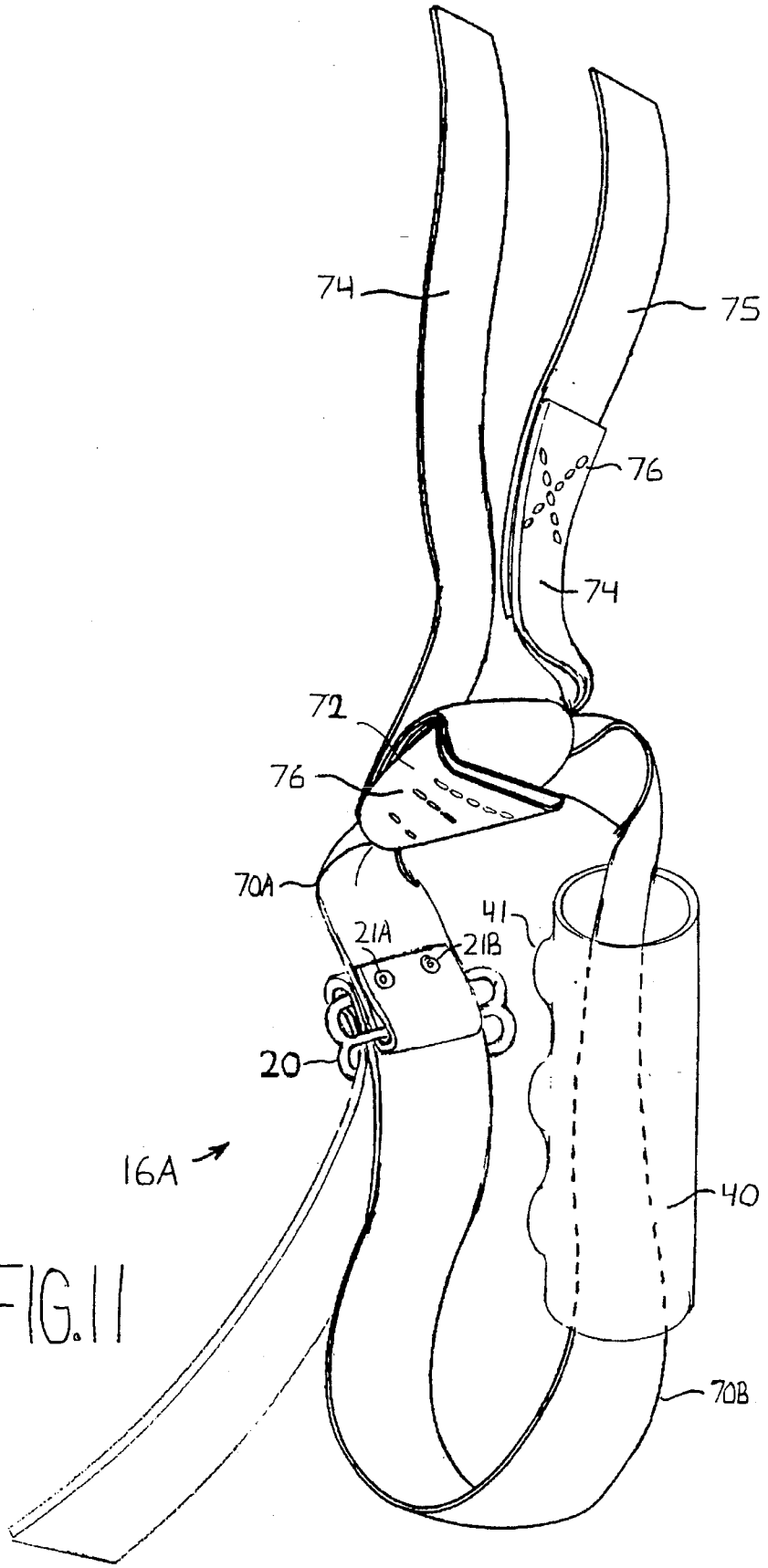
FIG. 11 illustrates improvements to anchorage element.

In FIG. 11 anchorage element #16A is shown with improvements. Belt #70 is divided into two portions #70A and #70B. #70A is connected around a buckle element #20 and folded and secured with two rivets #21A and #21B. Belt portion #70A may be equivalently connected to buckle element #20 by a buckle , clamp, stitches, glue or combinations thereof. Belt #70B is adjusted to the desirable length and inserted through the buckle and then inserted a second time to lock it in place thus forming a secure closure means, permitting the length of belt #70B to be adjusted. This permits exercise elements such as handle #40 with optional finger grips #41 or a pulley #34 or a strap #26A to be temporarily and interchangably coupled to the structural component without the use of a separate coupling element such as #22 or #22A. Various closure elements or means, such as a snaphook and receptacle, may be alternately used. By constructing #16A with an elongated belt #70B the use of a strap #26 may be eliminated. A tail portion #75 constructed of a resilient anti-skid material may be connected by stitches #76 or an equivalent means to shortened tail portion #74 if the material of anchorage element #16A has a high anti-friction coefficient. Alternatively tail portion #74 stopknot #72 and the portion of belt #70 that is frictionally clamped between the door and frame may be coated, imbedded, studded or sewn with an anti-slip substance.

Figure 12:
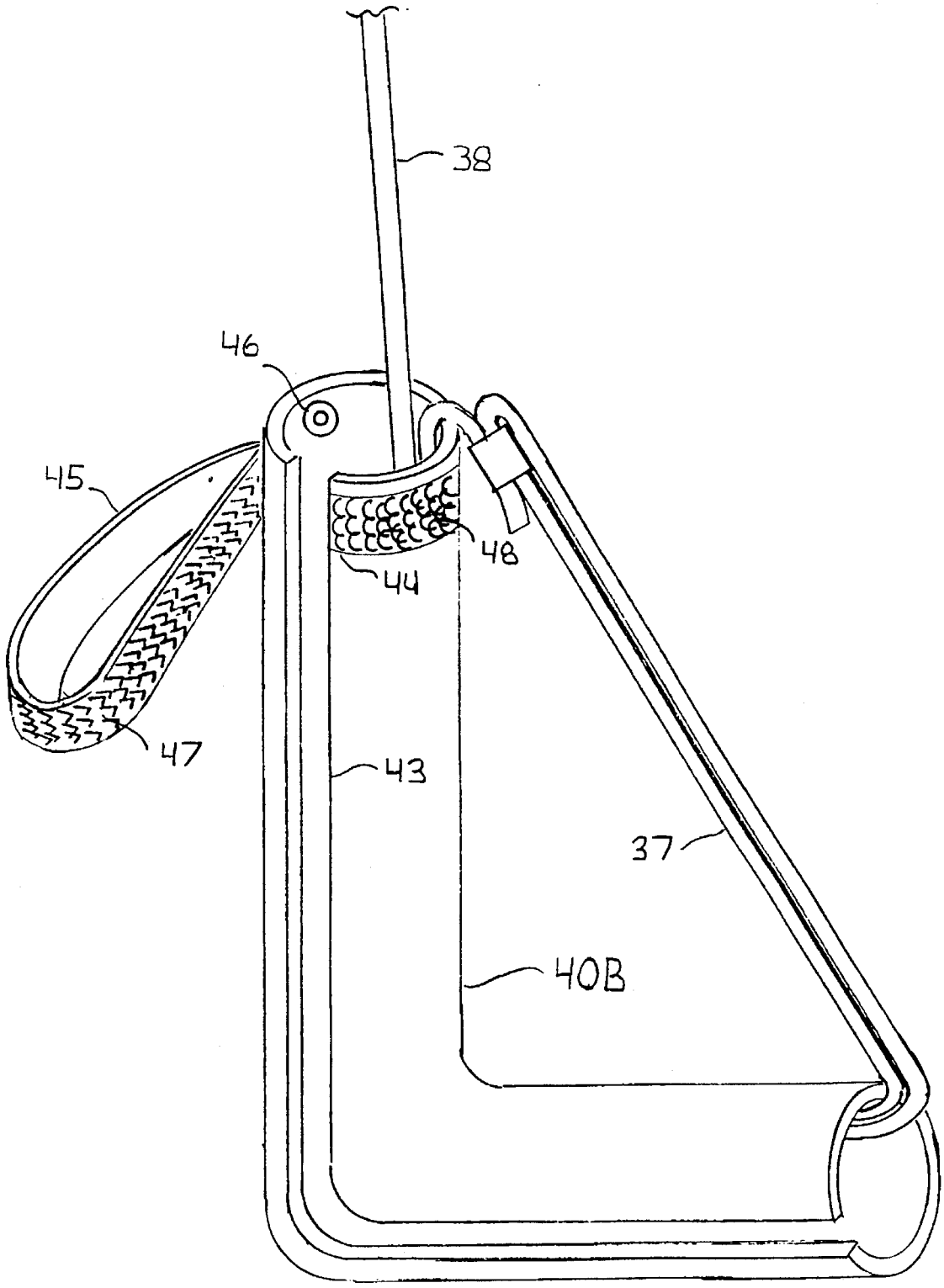
FIG. 12 illustrates a handle/stirrup with a slit and a closure element.

In FIG. 12 shows tubular handle #40B with improvements to simplify and speed the adjustment by cinching and storage of rope #38 . Rope #38 is formed into a loop #37 which is inserted into a slit #43 that runs along the entire outer bend of handle #40B. Rope #38 is looped around handle #40B and through Slit #43 until the rope or cable is adjusted to the desired length. Then closure element #45 with velcro hooks #47 is connected to closure element #44 with velcro loops #48, which is glued to handle #40B. Closure element #45 is constructed in a loop and attached with a rivet #46 so that the user's thumb may be inserted into the loop for easy one-handed attachment and detachment of the velcro. An equivalent safety closure element such as a swivel lock ring or a snap may be used. Handle #40B with slit #43 and closure elements #45 and #44 may be securely attached to Anchorage element #16 or Strap #26A directly without need of coupling element #22. Handle #40B may also be proportioned for additional use as a foot stirrup. If tubular handle #40B with Slit #43 is constructed of a flexible material it must have a second closure element at the other end.

Figure 13:
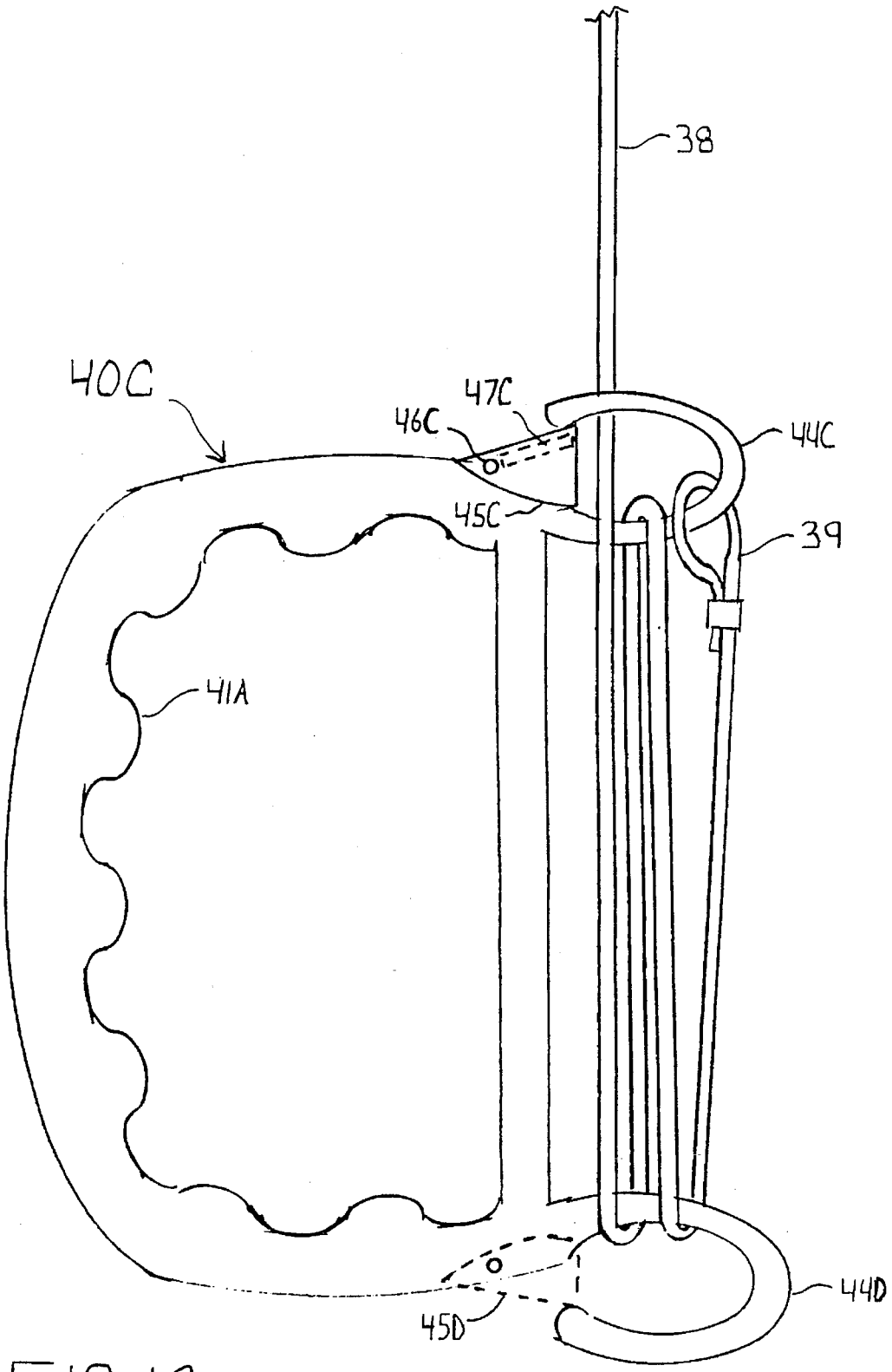
FIG. 13 illustrates a handle/stirrup with a closure element.

In FIG. 13 handle #40C with receptacle and gate and optional fingergrips #41C is shown with improvements . The twin receptacles #44C and #44D and U-shaped gate #45C are now located externally to the grip and handguard. Gate #45C pivots on pin #46C and is positioned close by tension of spring #47C. A second gate #45D may be optionally installed. Various closure elements or means such as sleeves may be alternately used. This permits adjustment by cinching and storage of rope #38 . Clamp #39 forms rope #38 into a loop which is inserted into a receptacle #44C . Rope #38 is looped around handle #40C and through receptacles #44C and #44D until the rope or cable is adjusted to the desired length. Handle #40C with receptacle #44C and closure element #45C may be securely attached to Anchorage element #16 or Strap #26A directly without need of coupling element #22. Handle #40C may also be proportioned for additional use as a foot stirrup.

Figure 14:
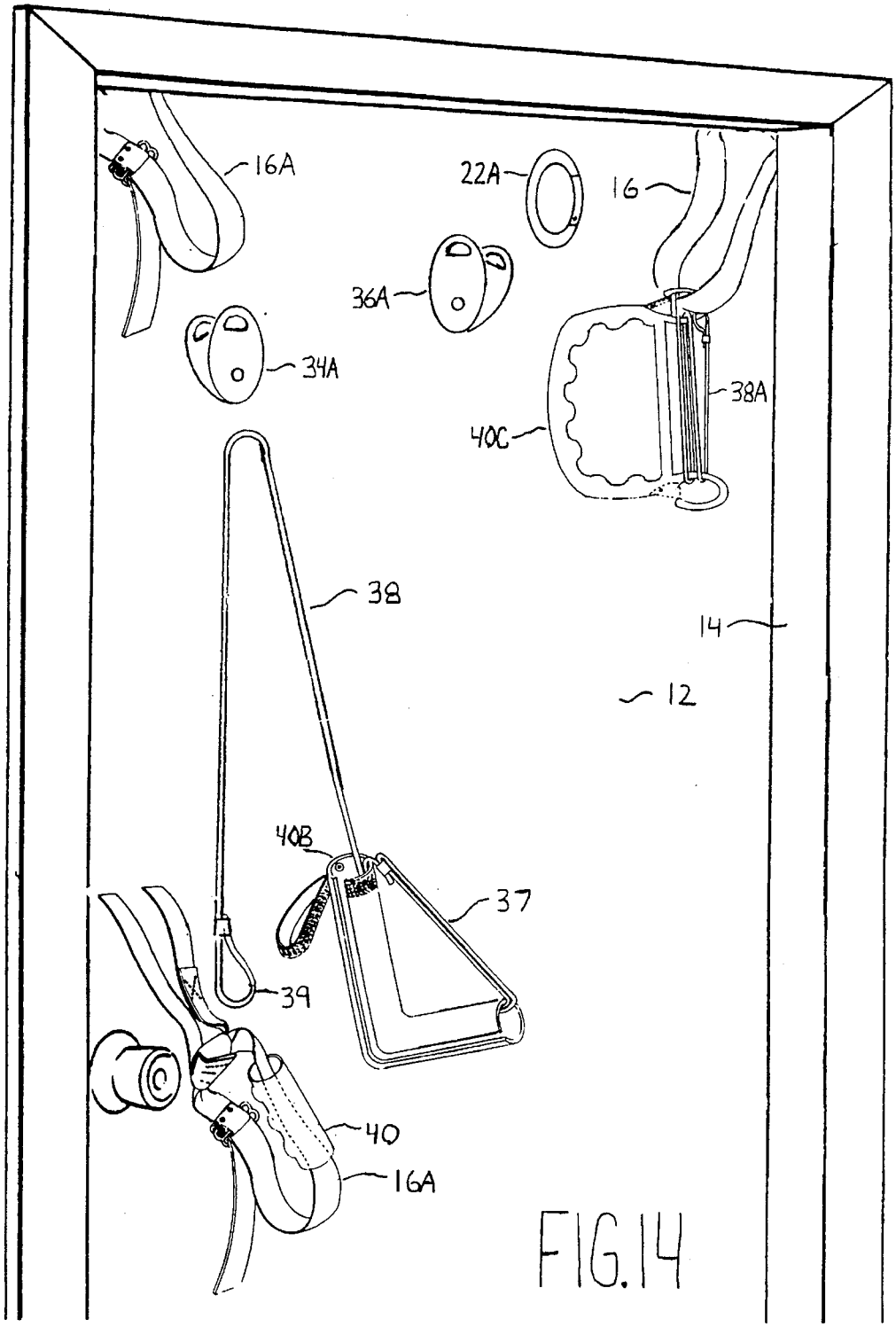
FIG. 14 illustrates a variety of interchangeable elements of the exercise device.
Figure 15:
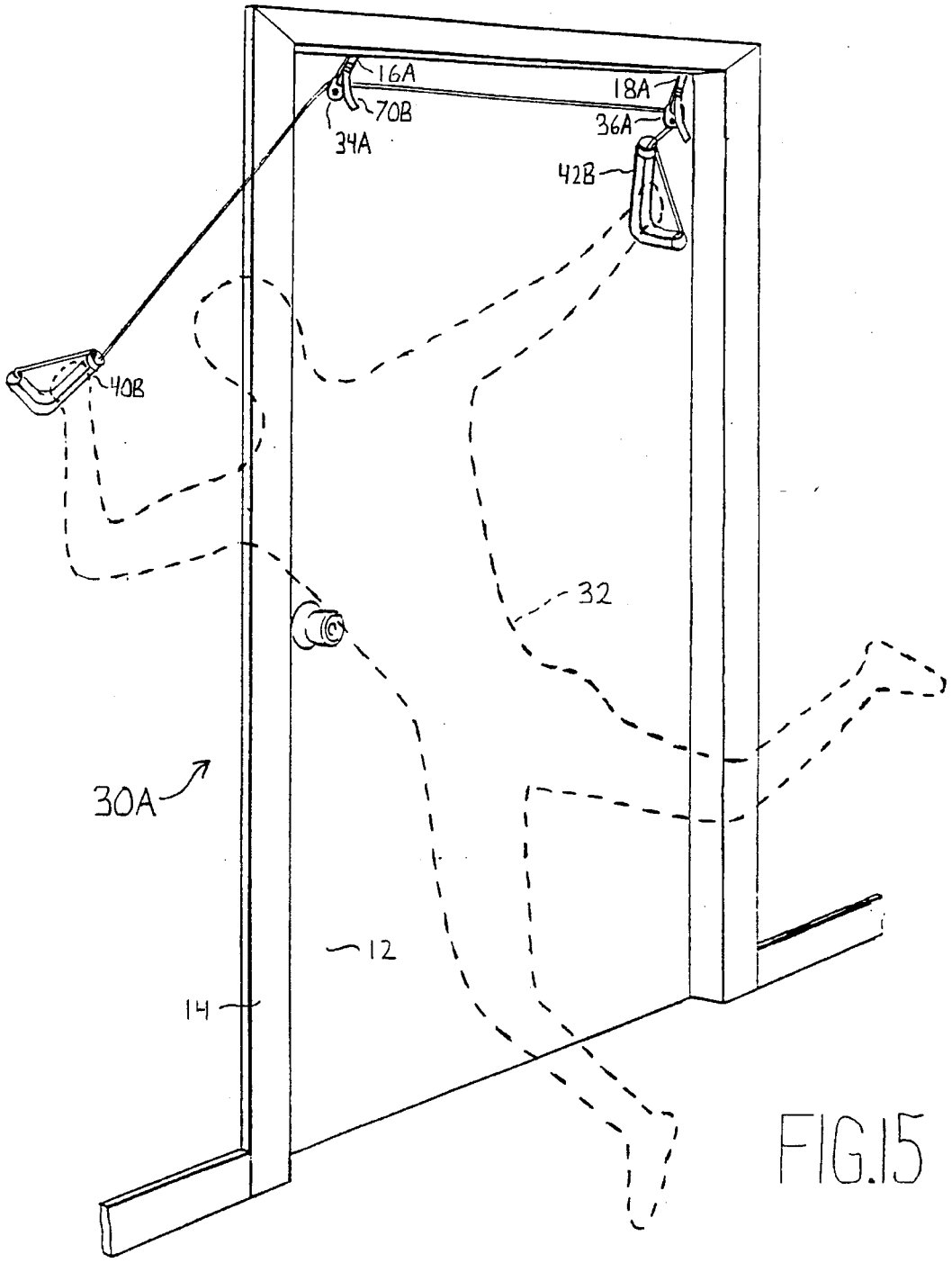
Fig.15 illustrates the device permitting a user to extend his center of gravity beyond the limits of gravity.
Figure 16:
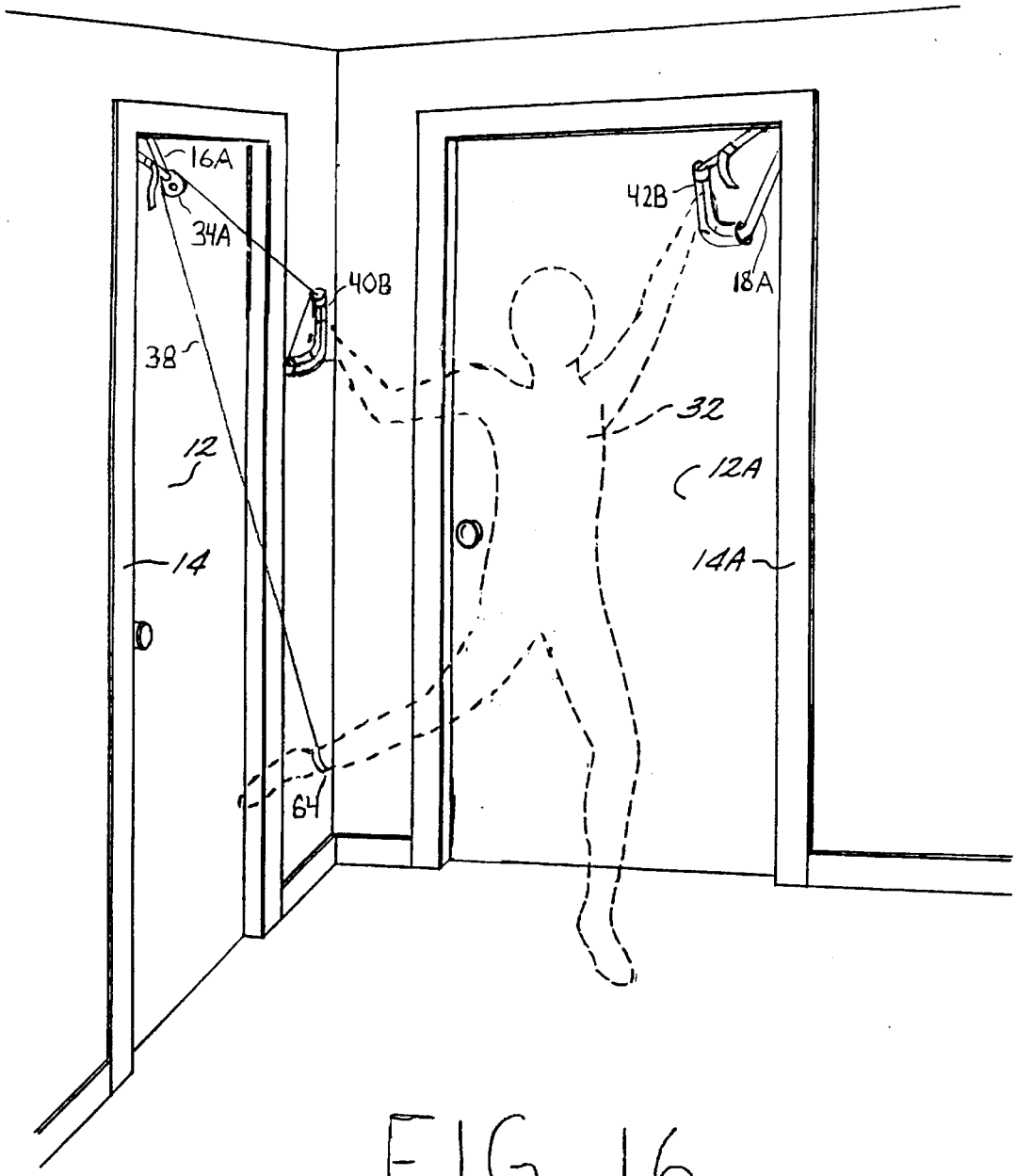
FIG. 16 illustrates various interchangeable elements of this device in use.

In FIG. 14 a variety of interchangeable elements of the exercise device are shown in an exploded view. Anchorage element #16 is frictionally clamped between door #12 and doorframe #14. Cable #38A is looped around gated handle/stirrup #40C, which is closably connected to anchorage element #16 .Two piece pulley #36A separates for quick connection of cable #38A and may be interchangeably or additionally connected by coupling element #22 to anchorage element #16. Anchorage element with closure means #16A is frictionally clamped between door #12 and doorframe #14. Handle/stirrup #40B with closure means is coupled by loop #37 to cable #38 which may be coupled to two piece pulley #34A which may in turn be directly coupled to anchorage element #16A with closure means. Loop #39 at the other end of cable #38 may be closably coupled to a duplicate anchorage element #16A which can be alternately used as a stirrup or cuff and handle #40 may also be attached. This arrangement would permit the user to stabilize himself by gripping handle #40C with one hand: while gripping handle #40C with the opposite hand and inserting the opposite foot in duplicate element #16A for stretching or reciprocally resisting that leg. A triplicate anchorage element #16A could be added and connected to cable #38A via elements #16,#40C, #22 and#36A permitting a dual cable/pulley arrangement with the right arm reciprocally resisting the right leg and alternating with the left arm reciprocally resisting the left leg. Cable #38A may be closably coupled by element #22 to element #16 to form a tether means whose length may be adjusted by handle #40C. Cable #38 may be directly coupled by loop #37 to element #16A to form a second tether which may be adjusted in length by handle #40B. Elements #40B, #38, #34A, #16A, #36A, #22, #16 and #40C or their functional equivalents may be closably connected to form a single cable ,double pulley exercise device. These various arrangements may be equivalently connected to one or more door/doorframe structures.

The coupling elements, gated swivel rings, straps and the like, illustrated in the above figures, provide an arrangement which functions in a secure yet quick-release manner making it practical to simply change the location of the apparatus and of the apparatus, itself, during an exercise session. Moreover, the arrangement permits free rotation in both the vertical and horizontal planes over a wide range of motion, thereby accommodating substantial freedom of movement when using the system.

With reference to the figures, generally, it should also be clear that the receptacles or apertures can be used for attachment of other exercise apparatus, such as apparatus for performing traditional resistance exercises for muscular development, such as presses, squats and curls.

For example, an unweighted bar may be attached to the unit near the floor (e.g., at the base of a door) to simulate a traditional barbell when lifted by the user. This system of resistance strength training allows for freedom of movement and the resulting development of muscular strength, power and endurance and overall balance and coordination from using free weights. Moreover, the plurality of apertures in various devices of this invention also provide free-standing systems for the attachment of traditional gymnasium equipment, such as a slant board, ballet bar or heavy punching bag.

As a framework for stretching, alignment and self-traction, the devices of this invention improve upon prior art points of resistance or tethering, generally suggested by experts and are in many applications equivalent to a human partner or trainer. By pushing or pulling against the framework of the device or against any apparatus attached from the apertures, such as roller-grip handles, stirrups, cuffs, straps or cables and pulleys, the body may be fully extended or flexed in any direction or combination of directions with complete control and safety for the purposes of warm-up and cool-down during exercise, development and maintenance of correct posture, proper skeletal alignment, relief of stress and tension, and therapy and rehabilitation of musculoskeletal injuries or handicaps. In addition, there are direct application to physical and occupational development therapy.

The most advanced professional and scientific theories of physical fitness emphasize unified, whole body fitness combining stretching, flexibility, and a full, natural range of movement with functional strength, power and endurance. It is important to develop kinesthetic awareness and utilize a dynamic range of motion which equals the desired range of motion which will stretch ligaments and muscles on order to exercise the whole body. One problem with small exercise devices is that they will exercise isolated muscles, but it has been found more important to use whole body movements to exercise major muscle groups. Whole movements are further thought to be better for exercises because the mid-course corrector muscles and the core stabilizer muscles are utilized with such large exercise motions, and total coordination and balance are increased. Therefore, it is important that instead of separately stretching and then exercising, one both exercises and incorporates the stretching elements within the exercises to help elongate the muscles. Such combination exercises are more advantageous to the joints and ligaments, and assist in achieving functional, whole body fitness.

The unique combination of proportion, stability and multiple free-floating attachment means into the apertures common to all the embodiments of the device of this invention, generates new whole body exercises which stretch and strengthen at the same time. These standing exercises use one's own bodyweight leveraged against and/or tethered to the framework of the device or apparatus thereto, and propelled by rhythmic, whole body movements, utilize the natural mobility of the joints and elasticity of the muscles. These exercises may be done with an aerobic-type cadence and greater leverage to emphasize power and strength, or with an aerobic-type cadence and less leverage to emphasize muscular endurance, but always with full extension and flexibility. Such exercises also develop coordination, balance and agility. Simultaneous stretching and strengthening exercises use similar positions and apparatus as the stretching exercises but with arms and legs bent and dynamic isokinetic movement to produce the reciprocating eccentric and concentric muscular contractions which lengthen and strengthen the musculature. These movements include rocking, twisting, swaying, leaning, thrusting, dancing and their back and forth, lateral, angled or reciprocating variations. All these innovative exercises have the same whole body fitness benefits as gymnastics but have an even greater factor of safety and require an even lower beginning skill level than that required by traditional or modified gymnastic exercises performed on the devices of this invention.

I claim:

1. In an exercise device adapted for connection to a doorframe, the improvement comprising:

inelastic tether means for performing a plurality of distinct kinesthetic exercises with a wide range of body motion including:

an inelastic cable and a pair of separate reciprocating pulleys adapted for quick releasable and replaceable coupling to the doorframe in a freely rotatable manner, said cable having a handle at each end and being reeved through said pulleys intermediate its ends, and adjustment means for adjusting the length of the cable such that the exercise device can be employed to accommodate a variety of kinesthetic exercises, said adjustment means including at least one said handle having a closable means for cinching and storing the cable; and attachment means for attachment of the exercise device to a doorframe, between the doorframe and the closed door, and providing free rotation of the exercise device in both vertical and horizontal planes over a wide range of motion, the attachment means including:

anchor means for defining a plurality of fixable locations on the doorframe from which kinesthetic exercises can be supported; and safety coupling means for attachment of said tether means and for accommodating a wide range of motion;

said attachment means providing at least two spaced-apart gravitational stability points to maintain balance and safety during use suitable for a variety of kinesthetic exercises.

2. The device of claim 1 wherein said anchor means comprises a belt having a stopknot at one end for positioning on one side of a door and connected at the other end to said safety coupling means for positioning on the other side of a door.

3. The device of claim 36 wherein said belt further includes tail portions for adjusting the thickness of said belt to accommodate variations in clearance between the door and its frame.

4. The device of claim 1 wherein said closable means for cinching and storing the cable comprises at least two receptacles at least one of said receptacles having a closable gate.

* * * * *